US005439112A

United States Patent [19]

De Guglielmo et al.

[11] Patent Number: 5,439,112

[45] Date of Patent: Aug. 8, 1995

[54] BLANK FOR FORMING A TUBULAR ENVELOPE OF CARD FOR GROUPING POTS TOGETHER, AND A PACK MADE IN THIS WAY

[75] Inventors: Pascal De Guglielmo, Montgueux; Gérard Beaucote, les Noes Pres Troyes, both of France

[73] Assignee: Aries Packaging, Societe Anonyme, Breviandes, France

[21] Appl. No.: 214,295

[22] Filed: Mar. 17, 1994

[30] Foreign Application Priority Data

Mar. 17, 1993 [FR] France ..... 93 03083

[51] Int. Cl.[6] ..... B65D 71/00

[52] U.S. Cl. ..... 206/434; 206/147

[58] Field of Search ..... 206/139, 140, 147, 149, 206/427, 428, 429, 434, 435; 229/40

[56] References Cited

U.S. PATENT DOCUMENTS

| | | | |
|---|---|---|---|
| 4,164,286 | 8/1979 | Sutherland | 206/434 |
| 4,489,880 | 12/1984 | Calvert . | |
| 4,703,847 | 11/1987 | Oliff | 206/434 |
| 4,756,419 | 7/1989 | Le Bras | 229/40 |
| 5,031,770 | 7/1991 | Chaussadas | 206/434 |
| 5,107,986 | 4/1992 | Cooper | 206/434 |

FOREIGN PATENT DOCUMENTS

| | | | |
|---|---|---|---|
| 0413986 | 2/1991 | European Pat. Off. | 206/427 |
| 0541385 | 5/1993 | European Pat. Off. | 206/429 |
| 2207903 | 2/1989 | United Kingdom . | |
| 92/04251 | 3/1992 | WIPO | 206/429 |

*Primary Examiner*—Jimmy G. Foster
*Attorney, Agent, or Firm*—Young & Thompson

[57] ABSTRACT

The invention relates to a blank of card or the equivalent designed to form a tubular envelope surrounding two pots or juxtaposed series of pots such as pots for milk products or desserts, the blank being of the type comprising a plurality of juxtaposed panels connected to one another along mutually parallel longitudinal fold lines, namely a central panel, two side panels adjacent to the central panel, and two end panels adjacent to respective ones of the two side panels; cut lines and fold lines being provided on at least one of the panels to define fold-out wedging elements in the panel, the wedging elements being suitable for projecting from the panel to wedge or contribute to the wedging of the pots in the pack comprising the pots surrounded by the envelope.

10 Claims, 3 Drawing Sheets

BLANK FOR FORMING A TUBULAR ENVELOPE OF CARD FOR GROUPING POTS TOGETHER, AND A PACK MADE IN THIS WAY

The invention relates firstly to a card blank designed to form a tubular envelope for grouping together pots or series of juxtaposed pots such as those used for milk products or desserts, and secondly to a pack containing such pots and to a tubular envelope made from such a blank.

BACKGROUND OF THE INVENTION

Blanks of this type are already known that comprise a plurality of juxtaposed panels, connected to one another via longitudinal fold lines that are mutually parallel: a central panel, two side panels adjacent to the central panel, and two end panels adjacent to the two side panels.

Blanks of that type are known in which provision is made on at least one of the panels for cutout lines and for fold lines that define fold-out wedging means, suitable for projecting from said panel to contribute to wedging said pots within the pack.

In the application considered therein, the wedging means seek to wedge the bottom portions of the pots.

From document EP-A-0 277 030, blanks are known in which wedging means are provided in the form of a beam that extends longitudinally. Document GB-A-2 207 903 shows another embodiment in which the wedging means are fold-out tabs. It is also possible to envisage having the bottom wall of the pack made from two panels of the blank that are glued to each other or that are locked together by means of a system of tabs and notches. Another example of the prior art is described in document U.S. Pat. No. 4,489,880.

OBJECTS AND SUMMARY OF THE INVENTION

The invention seeks to provide a blank and a pack in which the wedging means are taken from the card constituting the blank, without removing or adding material, while nevertheless improving wedging. The invention makes it possible to implement a pack that presents qualities of cheapness, ease of implementation, pleasing appearance, and ease of use.

The present invention provides a blank of card or equivalent material designed to form a tubular envelope surrounding two pots or juxtaposed series of pots such as pots for milk products or desserts, the blank being of the type comprising a plurality of juxtaposed panels connected to one another along mutually parallel longitudinal fold lines, namely a central panel, two side panels adjacent to the central panel, and two end panels adjacent to respective ones of the two side panels;

cut lines and fold lines being provided on at least one of the panels to define fold-out wedging means in said panel, the wedging means being suitable for projecting from said panel to wedge or contribute to the wedging of said pots in the pack comprising the pots surrounded by the envelope, wherein:

a) the blank includes one or a series of wedging means on the central panel and disposed symmetrically relative to a longitudinal midline of symmetry parallel to the fold lines, each wedging means wedging or contributing to the wedging of two facing pots;

b) each wedging means comprises:

a wedging wall whose two opposite longitudinal edges extend in a generally axial direction and are shaped so that in the deployed position of the wedging wall they fit snugly against the side faces of two facing pots;

a support wall joined to the central panel along a first transverse fold line and joined at its opposite end to the wedging wall along a second transverse fold line; and two wedging flaps joined to the longitudinal edges of the support wall along respective fold lines;

c) each wedging means being completely formed by cutting and folding the central panel without any additional material.

The invention also provides a pack comprising two pots or juxtaposed series of pots such as pots for milk products or desserts, and a tubular envelope which surrounds them and holds them together, said envelope having a bottom portion on which the pots stand, two side portions placed against the side faces of the pots, and a top portion overlying the top faces of the pots, wedging means adjoining the bottom portion to wedge or participate in the wedging of the pots near the bottom portions thereof, the pack including on its bottom portion one or a series of wedging means disposed symmetrically relative to a longitudinal midline of symmetry parallel to the fold lines; and wherein each wedging means comprises a deployed wedging wall placed above and substantially parallel to the central panel, having opposite longitudinal edges that extend in a generally axial direction and that are shaped to fit snugly against the side faces of two facing pots; said wedging wall being carried at one end by an inclined support wall connected to the central panel; two wedging flaps adjoining the support wall projecting therefrom and being directed away from the central panel to come against the side faces of the pots.

BRIEF DESCRIPTION OF THE DRAWINGS

Other characteristics and advantages of the invention appear from the following description given with reference to the accompanying drawings, in which.

MORE DETAILED DESCRIPTION

The invention relates to a blank 1 of card or equivalent material that is intended to form a tubular envelope surrounding two pots or two series of juxtaposed pots 2 such as pots for containing milk products or desserts.

Figure 1:
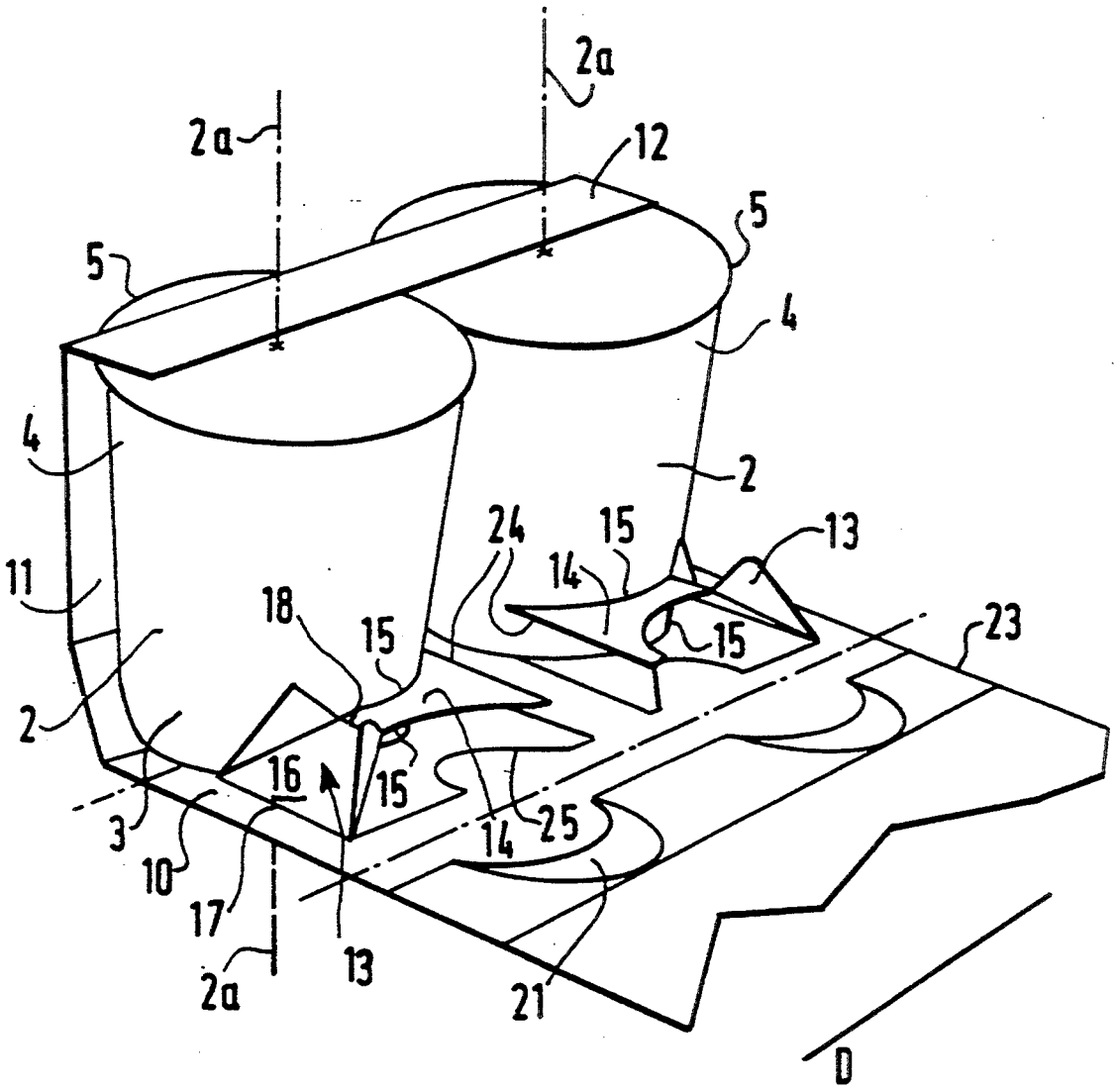
FIG. 1 is a diagrammatic fragmentary perspective view of a pack of the invention, with the envelope of the pack being shown partially in place and partially unfolded.

In the pack to which the present invention applies and as shown in FIG. 1, a single layer of pots is provided. The pack comprises the pots 2 and the envelope made from the blank 1 which is closed and secured to itself so as to maintain cohesion for the pots 2.

The pots 2 may be individualized relative to one another or they may be connected together either in pairs or in a layer.

Each pot 2 is generally frustoconical in shape or else in the form of a truncated pyramid having a bottom portion 2 that is smaller in size than a top portion 4. In the normal position of the pack, each pot 2 has its axis 2*a* vertical or substantially vertical, the bottom portion 3 constituting the bottom of a pot and the top portion 4 constituting its opening which is often sealed.

The top portion 4 of such pots 2 is generally provided with a peripheral rim 5.

The blank 1 comprises a plurality of juxtaposed panels that are connected together via mutually parallel fold lines extending longitudinally in the longitudinal direction referenced D.

The blank 1 in question has a central panel 7, two side panels 8 adjacent to the central panel 7, and two end panels 9 adjacent to respective ones of the two side panels 8.

The resulting pack comprises a bottom portion 10 on which the bottom portions 3 of the pots 2 stand, two side portions 11 constituted by respective ones of the side panels 8, and a top portion 12 resting on the top faces of the top portions 4 of the pots 2. In the pack, the envelope made from the blank 1 is formed into a loop, with the two end portions of the blank being secured to each other by gluing, welding, mechanical fastening, or in some other way.

The bottom portion 10 is either complete, as shown, or else it is provided with holes (not shown) for receiving the pots 2.

In the embodiment shown in FIG. 1, the bottom portion 10 is constituted by the central panel 7. The top portion 12 is constituted by the two end panels 9 that are superposed and secured one to the other. In particular, the higher and outer end panel 9 overlies all of the pots going from one side panel 8 to the other, whereas the other end panel 9 which is placed below the preceding end panel is smaller and is designed to constitute a flap for securing to the first-mentioned end panel. To contribute to wedging the pots, cutouts 20 are provided in the side panels 8*b* in the vicinity of the fold lines joining them to the end panels 9. The rims 5 of the pots co-operate with the cutouts.

The bottom portion 10 may be made from two panels that are secured to each other, in which case the top portion 12 is constituted by a single panel.

Figure 2:
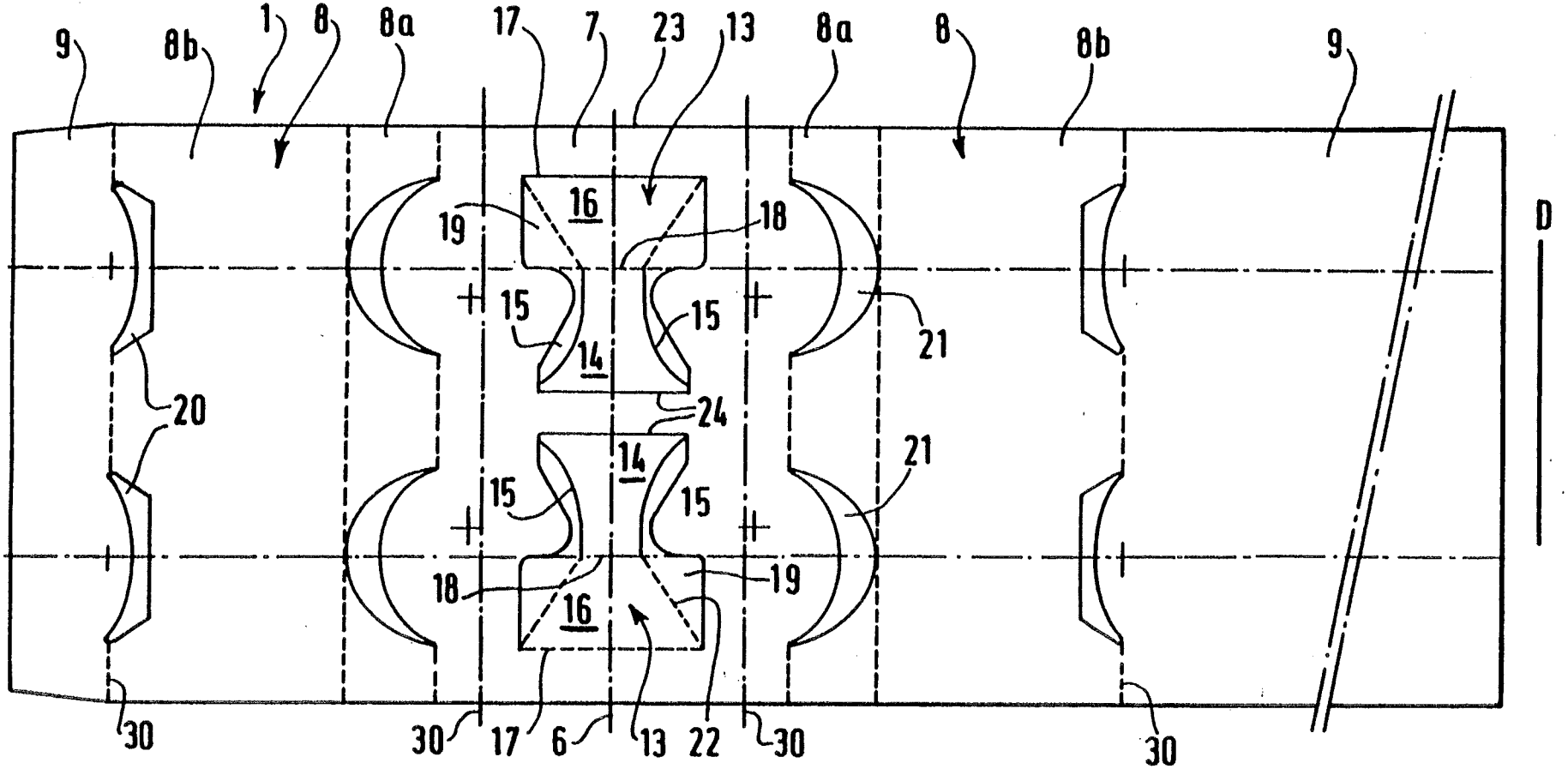
FIG. 2 is a diagrammatic elevation view of the blank of the invention.
Figure 3:
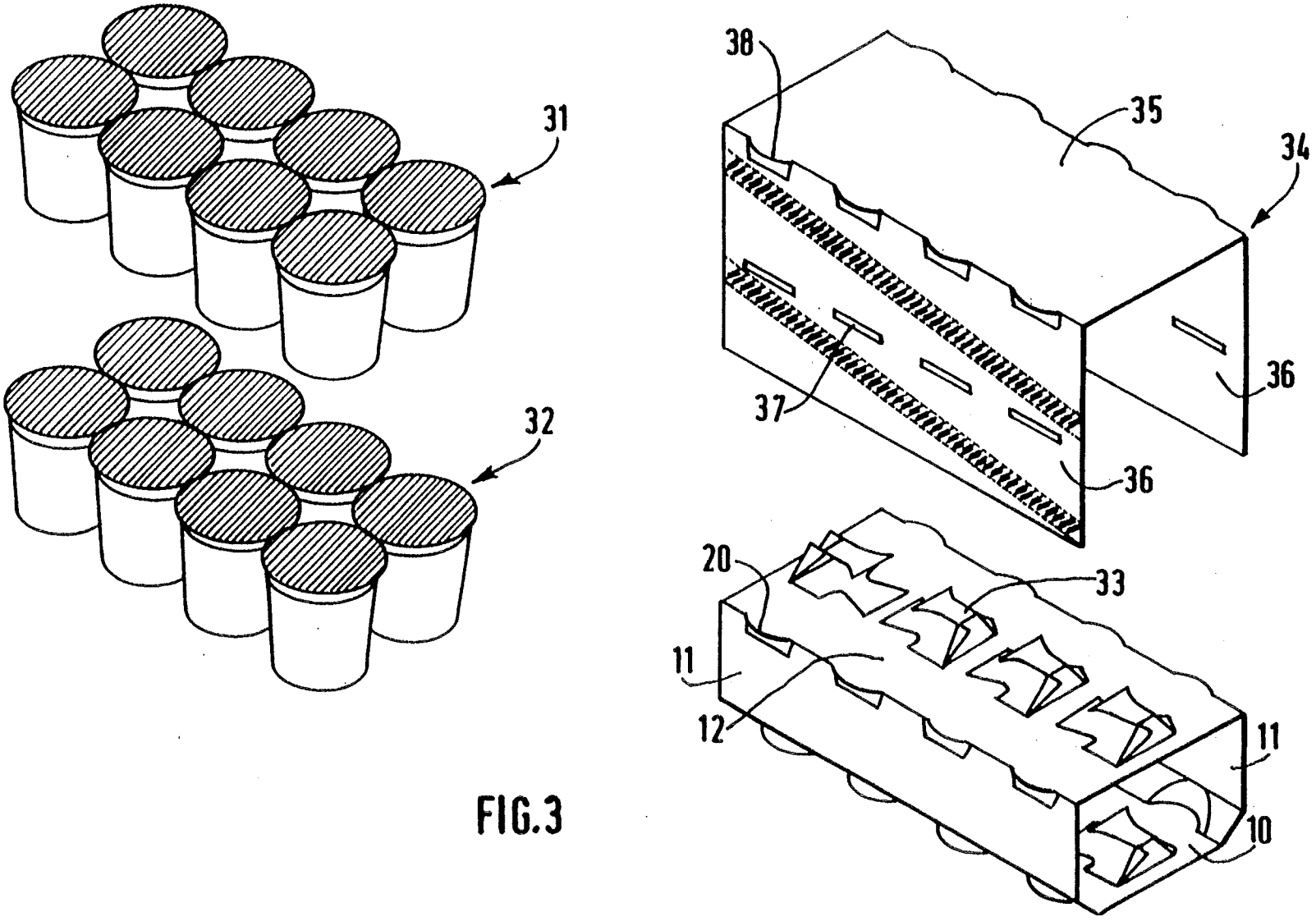
FIG. 3 is a diagrammatic perspective view of a second pack of the invention including two superposed layers of pots.

In the variant shown in FIGS. 1 and 2, each of the side panels 8 is in the form of two hinged-together subpanels, namely a subpanel 8*a* adjacent to the central panel 7 and a subpanel 8*b* adjacent to one of the end panels 9. Crescent-shaped cutouts 21 are formed in subpanel 8*a* with the corresponding material of the blank being removed, which cutouts co-operate with the side faces of the pots, substantially opposite to wedging means described below.

Cut lines and fold lines are provided on at least one of the panels (in the present case on the central panel 7) or of the bottom portion 10, thereby defining wedging means 13 in said panel 7 or said portion 10.

The wedging means 13 may either be flat, i.e. lie in the same plane as the blank 1 when it is flat, prior to assembly, or else they may project relative to said panel 7 or said portion 10 on being deployed, the wedging means 13 being folded about said fold lines.

When they project, the wedging means 13 provide wedging for, or assist in the wedging of the pots 2, and in particular the bottom portions 3 thereof.

According to the invention, the central panel 7 or the bottom portion 10 includes one or a series of wedging means 13 disposed symmetrically about a longitudinal midline of symmetry 6 parallel to the fold lines 30 of the panels 7, 8, and 9. Each of the wedging means 13 wedges or participates in the wedging of two facing pots and comprises:

- a wedging wall 14 whose two opposite longitudinal edges 15 extending generally in the axial direction are shaped so that when the wedging wall 14 is in its deployed position they fit snugly round the side faces of two facing pots;
- a support wall 16 joining the central panel along a first transverse fold line 17 and joining the wedging wall 14 at its opposite end along a second transverse fold line 18; and
- two wedging flaps 19 joined to the longitudinal edges 15 of the support wall 16 along respective fold lines 22.

The shaped longitudinal edges 15 of the wedging wall 14 are curved with the convex side of the curve facing towards the center of said wall 14. The support wall 16 is generally in the form of an isosceles trapezium whose large base is the fold line 17 where it joins the central panel 7 and whose small base is the fold line 18 where it joins the wedging wall 14. The fold lines 22 for the wedging flaps 19 are rectilinear. Each wedging flap 19 is substantially in the form of a right angled triangle. Fold line 17 joining the support wall 16 to the central panel 7 is situated close to one of the transverse edges 23 of said central panel 7.

It will be understood from the above description that the wedging wall 14 includes a free transverse edge 24 at its end opposite from the fold line 18 joining it to the support wall 16.

In FIG. 2, it can be seen that at the wedging means 13 the central panel 7 has a cutout 24 and a fold line that define a T-shape with a flared bottom end.

Once the pack has been assembled, the wedging wall 14 is placed substantially in the same plane as the cutouts 21 in the panels 8*a*. The pots are thus held on opposite sides by the wedging means 13 and by the cutouts 21, with the wedging means constituting spacers. Relative to the central panel 7, the support wall 16 is at an angle lying in the range 15° to 50°.

The fold lines of said blank 1 may be made by cutting and scoring. Thus they cause no material to be removed nor added. This makes it easier to store the blanks while they are flat, and this characteristic is favorable both from the point of view of cost and from the point of view of pack strength, and finally it constitutes an aid during assembly.

In a variant embodiment, the pack of the invention includes a plurality of superposed layers of pots, namely a top layer 31 and a bottom layer 32.

To this end, the single layer pack as described above is provided on its top portion 12 with cut lines and fold lines that define wedging means 33 identical to the wedging means provided in the bottom portion 13 and which serve to wedge the bottom portions of the top layer 31 of pots.

A top blank 34 is designed to co-operate with the top portion 12 of the single layer pack to form a top tubular envelope surrounding the top layer 31. To this end, the top blank 34 includes another top portion 35 and two side portions 36 adjacent to said other top portion 35.

The top tubular envelope for the top layer 31 is thus closed by securing the ends of the top blank 34 to the side portions 11 of the single layer pack. If the single layer pack includes cutouts 20 for contributing to the wedging of the bottom layer 32 of pots, then the side portions 36 of the top blank 34 include cutouts 37 disposed so that they coincide with the cutouts 20 of the single layer pack when the top tubular envelope is closed.

To contribute to the wedging of the top layer 31, the two-layer variant is provided with cutouts 38 situated in the top portion 35 in the vicinity of the fold lines where it joins the side portions 36.

What is claimed is:

1. A blank of card designed to form a tubular envelope surrounding a plurality of pots arranged in two or more rows and in at least one tier, the blank comprising a plurality of juxtaposed panels connected to one another along mutually parallel longitudinal fold lines, a central panel, two side panels adjacent to the central panel, and two end panels adjacent to respective ones of the two side panels;

cut lines and fold lines being divided on at least one of the panels to define fold-out wedging means in said panel, the wedging means being suitable for projecting from said panel to wedge said pots in a pack comprising the pots surrounding by the envelope, wherein:

a) the blank includes one or a series of said wedging means on the central panel and disposed symmetrically relative to a longitudinal midline of symmetry parallel to the fold lines, each wedging means adapted to wedge two facing pots;

b) each wedging means comprising:

a wedging wall having two opposite longitudinal edges extending in a generally axially direction and shaped so that in a deployed position of the wedging wall, said longitudinal edges fit snugly against side faces of two facing pots;

a support wall joined to the central panel along a first transverse fold line and joined at its opposite end to the wedging wall along a second transverse fold line; and two wedging flaps joined to the longitudinal edges of the support wall along respective fold lines;

c) each wedging means being completely formed by cutting and folding the central panel without any additional material.

2. A blank according to claim 1, wherein the shaped longitudinal edges of the wedging wall are curved with a convex side of the curve facing towards the center of said wedging wall.

3. A blank according to claim 1, wherein the support wall is generally in the form of an isosceles trapezium whose large base is the fold line joining it to the central panel, and whose small base is the fold line joining it to the wedging wall.

4. A blank according to claim 1, wherein the fold lines of the wedging flaps are rectilinear.

5. A blank according to claim 1, wherein each wedging flap is substantially in the form of a right-angled triangle.

6. A blank according to claim 1, wherein the fold line joining the support wall to the central panel is situated close to a transverse edge of said central panel.

7. A pack comprising a plurality of juxtaposed pots, and a tubular envelope which surrounds said pots and holds them together, said envelope having a bottom portion on which the pots stand, two side portions placed against side faces of the pots, and a top portion overlying top faces of the pots, wedging means adjoining the bottom portion to wedge the pots near bottom portions thereof, the pack including on its bottom portion one or a series of said wedging means disposed symmetrically relative to a longitudinal midline of symmetry parallel to fold lines; and wherein each wedging means comprises a deployed wedging wall placed above and substantially parallel to a central panel, having opposite longitudinal edges that extend in a generally axial direction, said longitudinal edges being shaped to fit snugly against the side faces of two facing pots; said wedging wall being carried at one end by an incline support wall connected to the central panel; and two wedging flaps adjoining the support wall projecting therefrom and being directed away from the central panel to bear against the side faces of the pots.

8. A pack according to claim 7, wherein relative to the central panel, the support wall is at an angle lying in the range of 15° to 50°.

9. A pack according to claim 7, wherein the pots are arranged in a single layer.

10. A pack according to claim 7, wherein the pots are arranged in a plurality of superposed layers.

* * * * *